US008276768B1

(12) United States Patent
Johnson

(10) Patent No.: US 8,276,768 B1
(45) Date of Patent: Oct. 2, 2012

(54) MAGNETIC KNIFE GUARD DEVICE

(76) Inventor: Bart A. Johnson, Jacksonville Beach, FL (US)

( * ) Notice: Subject to any disclaimer, the term of this patent is extended or adjusted under 35 U.S.C. 154(b) by 59 days.

(21) Appl. No.: 12/815,949

(22) Filed: Jun. 15, 2010

(51) Int. Cl.
*A47F 7/00* (2006.01)

(52) U.S. Cl. ..... 211/70.7; 206/350; 206/818; 206/379

(58) Field of Classification Search ..... 206/818, 206/350, 379; 211/70.7; 248/37.3, 206.5, 248/37.6
See application file for complete search history.

(56) References Cited

U.S. PATENT DOCUMENTS

| | | | | |
|---|---|---|---|---|
| 2,966,992 | A * | 1/1961 | Dunkelberger et al. | 211/70.7 |
| 3,229,820 | A | 1/1966 | Hentzi et al. | |
| 4,263,714 | A | 4/1981 | Todd, Sr. | |
| 4,586,616 | A | 5/1986 | Cooper et al. | |
| 4,718,200 | A | 1/1988 | Miquelot | |
| 5,011,102 | A | 4/1991 | Kiefer | |
| 5,020,666 | A | 6/1991 | Barlean | |
| 5,301,822 | A | 4/1994 | Coleman et al. | |
| 5,379,520 | A | 1/1995 | Collins | |
| 5,544,747 | A | 8/1996 | Horn | |
| 5,669,516 | A | 9/1997 | Horn | |
| 5,979,673 | A | 11/1999 | Dooley | |
| 6,216,888 | B1 | 4/2001 | Chien | |
| 6,427,340 | B1 | 8/2002 | Cohen | |
| 6,434,838 | B1 * | 8/2002 | Mai | 30/504 |
| 6,457,239 | B1 | 10/2002 | McLaughlin | |
| 6,718,637 | B1 | 4/2004 | Ortner et al. | |
| 7,422,180 | B2 | 9/2008 | Tang | |
| 7,802,688 | B1 * | 9/2010 | Ruan | 211/70.7 |
| 7,971,736 | B1 * | 7/2011 | Stewart | 211/70.7 |
| 2002/0175131 | A1 | 11/2002 | Johnson | |
| 2004/0239460 | A1 | 12/2004 | Kocijan | |
| 2005/0258059 | A1 | 11/2005 | Joyce et al. | |
| 2007/0023304 | A1 * | 2/2007 | Joyce et al. | 206/350 |
| 2008/0060205 | A1 | 3/2008 | Schmidt et al. | |
| 2008/0289191 | A1 | 11/2008 | LeBlanc et al. | |
| 2009/0106982 | A1 | 4/2009 | Kushner | |

FOREIGN PATENT DOCUMENTS

| | | | |
|---|---|---|---|
| GB | 2460914 | A | 12/2009 |
| JP | 2008264415 | A | 11/2008 |

OTHER PUBLICATIONS

Epicurean, Magnetic Knife Holder, http://www.epicureancs.com/knifeholders.php, accessed on Apr. 21, 2010.
Grunwerg Seqra Magnetic Knife Stand, http://www.kitchendresser.net/grunwerg-seqra-magnetic-knife-stand-4955-p.asp, accessed on Apr. 21, 2010.
Global Magnetic Knife Guard—Size 4, http://www.kitchendresser.net/global-magnetic-knife-guard—size-4-5688-p.asp, accessed on Apr. 21, 2010.
Bisbell Magmate Blade Guard Set 2pce Small, http://www.yourhomedepot.com.au/products/bisbell/magmate-blade-guard-set-2pce-small/, accessed on Apr. 21, 2010.

* cited by examiner

*Primary Examiner* — Mickey Yu
*Assistant Examiner* — Chun Cheung
(74) *Attorney, Agent, or Firm* — Nilay J. Choksi; Jeremy D. Spier; Smith & Hope, P.A.

(57) ABSTRACT

A magnetic knife guard that attaches to one side of a knife and enables a user to safely and easily store individual knives in a drawer or hang individual knives on kitchen utensil racks without damaging or dulling the cutting surface of the knife. An embedded magnet within the guard holds the guard to the blade while a plurality frictional contact pads prevent slipping or rotation of the guard on the blade.

12 Claims, 8 Drawing Sheets

MAGNETIC KNIFE GUARD DEVICE

BACKGROUND OF THE INVENTION

1. Field of the Invention

This invention relates to a magnetic holding device for knives. More specifically, it relates to a magnetic holding device that enables a user to safely and easily store individual knives in a drawer or hang individual knives on kitchen utensil racks without damaging or dulling the cutting surface of the knife.

2. Description of the Prior Art

Current methods for storing cutlery, such as knife blocks and magnetic knife racks, have various shortcomings. For example, traditional slotted knife blocks provide limited visibility of the cutting edge, increase safety risks due to trapped bio-debris, have poor ergonomic design, facilitate premature dulling of blades, and waste counter space. Similarly, magnetic knife racks that hang on the wall have ergonomic challenges that expose the user to incidental contact with the cutting edge. Current magnetic knife racks damage blades due to cutting edge metal on metal contact or direct contact of the cutting edge with strong magnets which magnetize the edge, causing metal shavings to adhere to and damage the blade during sharpening. Magnetic knife racks are also generally limited in the orientation they can be mounted.

Current methods of magnetically holding knives have limitations in their safety, usability, and cost because of the way holding force is applied to the blade. They rely primarily on strong magnetic force to pull the blade into the attachment face in normal relation thereto, but neglect to maximize the sliding friction force parallel to the attachment face. They also neglect to design for rotational forces; for example, if the center of gravity of the knife is out of alignment with the magnetic holding point and the direction of gravity, the blade is susceptible to slipping, sliding or rotating, thus limiting the orientation the knife can be stored to the vertical direction. Two design methods are practiced to compensate for this limitation in conventional magnetic knife holders. First, additional mechanical holding points are added, such as a ledge or slot for the blade to rest on or another point of contact with the knife such as the bolster of the handle. This adds to the complexity of the device and limits the orientation in which it can be used. The second method is to increase the magnetic force, which increases friction between the blade and contact face. The stronger the magnetic force is, however, the harder it is for the user to remove the blade. Strong magnetic forces create usability problems such as the need for permanent mechanical attachment of the holder to the storage surface or large holder mass to resist the pulling force of a user trying to remove the blade. More concerning is the jerking movement of the knife blade at it is released, creating a serious safety issue. High attachment force also creates usability problems on attachment because the knife tends to be abruptly jerked away from the hand of the user, causing less control over the attachment orientation of the knife and blade damage because it is slammed against the attachment surface.

Current knife guards require a two-sided mechanism having an enclosed space for holding the knife blade securely. The blade is held between two surfaces by mechanical entrapment or is held between two magnetic surfaces by magnetic attraction. There are several disadvantages to a two-sided knife guard having an enclosed space. Because the enclosed space is hard to clean, it can become unsanitary. Similarly, water trapped in the enclosed space can damage the blade. Where a mechanism for closure is used, such as a hinge, this ads to the complexity, cost, and potential for fatigue failure over time. Two sided knife guards also hide the knife blades from view, which makes selection of the correct knife more difficult and reduces the aesthetic appeal of the knife, making it undesirable to hang or display on a utensil rack. Moreover, there is a significant ergonomic disadvantage to a two-sided knife guard having an enclosed space because it requires two hands to apply the guard to the knife blade and two hands to remove the guard. This is inconvenient for a Chef in a kitchen. It is also a safety hazard because the hand holding the guard can be cut when the knife is being inserted in the guard if the blade slips out or the guard fails.

A knife guard and holding device is needed that allows a user to safely and easily store individual knives in a drawer or hang individual knives on kitchen utensil racks without damaging or dulling the cutting surface of the knife. However, in view of the prior art considered as a whole at the time the present invention was made, it was not obvious to those of ordinary skill in the art how the limitations of the art could be overcome.

SUMMARY OF INVENTION

The long-standing but heretofore unfulfilled need for a knife guard and holding device that allows a user to safely and easily store individual knives in a drawer or hang individual knives on kitchen utensil racks without damaging or dulling the cutting surface of the knife is now met by a new, useful, and nonobvious invention.

Generally speaking, the invention includes a blade guard having at least one magnet embedded within its attachment face and a plurality of enhanced frictional contact pads disposed on the attachment face surface at discrete locations to create a moment arm sufficient to prevent rotation of an attached knife. The magnet and enhanced frictional contact pads are disposed at the end of the blade guard closest to the handle of an attached knife. To prevent magnetization of the cutting edge of an attached knife, the magnet is offset from the edge of the blade guard. The enhanced frictional contact pads may be positioned on the attachment face in overlying or nonoverlying relation to the magnet.

In a preferred embodiment, a hanging void is disposed within the blade guard at the end opposite the knife handle of an attached knife, enabling a user to hang the blade guard on kitchen racks. Moreover, a finger release lever is disposed at the end of the blade guard closest to the knife handle of an attached knife and within reach of an index finger or thumb of a user holding the knife, enabling one handed detachment of the blade guard. The finger release lever may be a compliant lever. A magnetic shield layer is disposed on the outer surface of the blade guard opposite the attachment face and prevents multiple blade guards from sticking together while hanging or stored in close proximity. The attachment face has a raised edge to prevent incidental contact with the knife blade. For improved safety, knife blade visibility, and aesthetics, the blade guard may be transparent.

In operation, a user simply places a knife against the attachment face of the blade guard. Once the knife is within the magnetic field of the magnet, the knife will be forced against the attachment face of the blade guard. The knife rests against the enhanced frictional contact pads, preventing the knife from sliding or rotating. The user then has the option of safely storing the knife in a drawer or hanging the knife on a kitchen utensil rack.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1A:
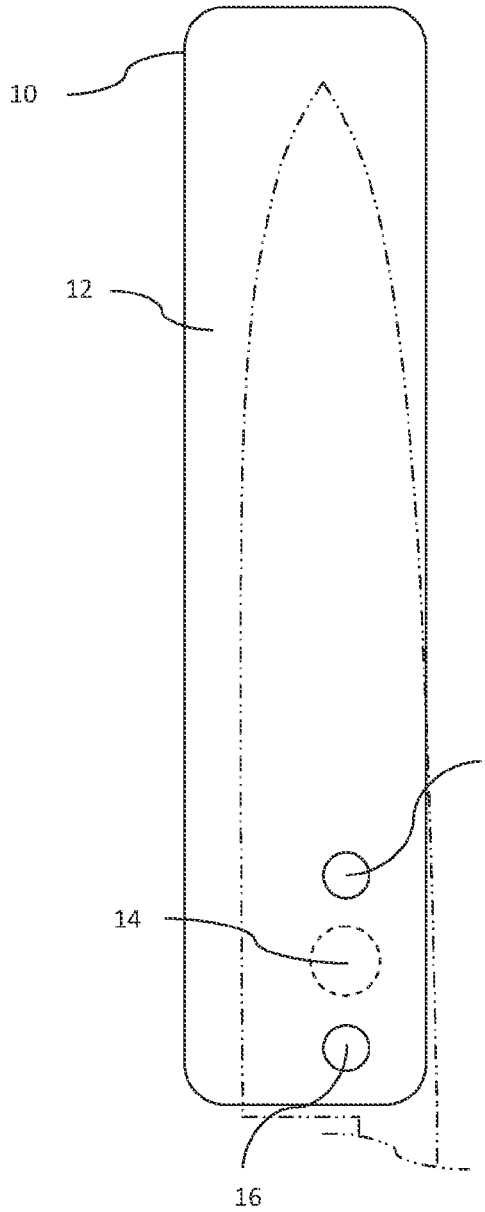
FIG. 1A is a front view of the device.
Figure 1B:
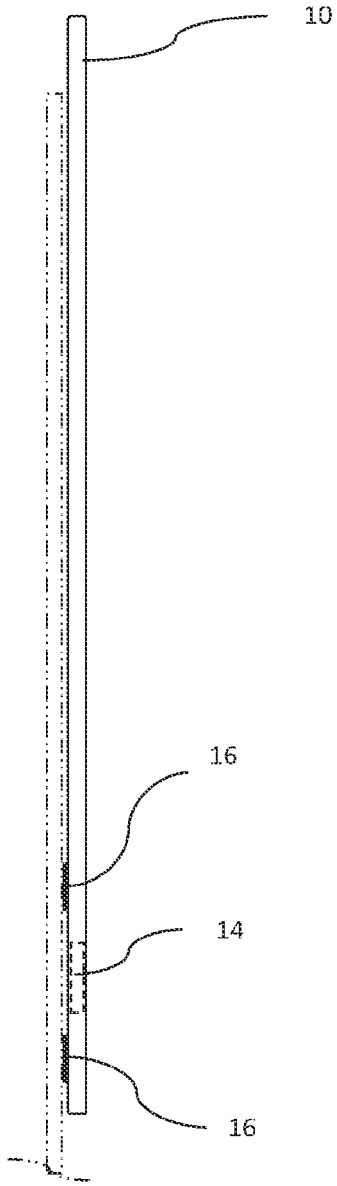
FIG. 1B is a side view of the device.
Figure 2A:
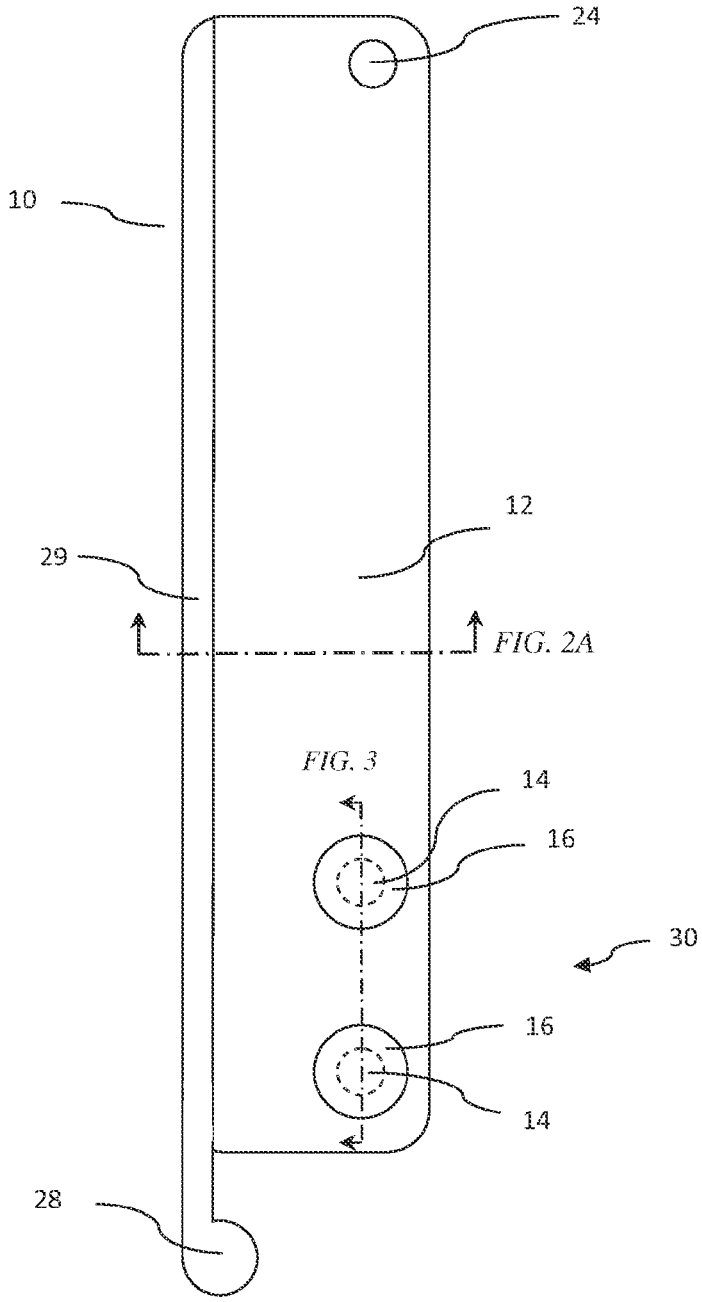
FIG. 2A is a front view of the device.
Figure 2B:
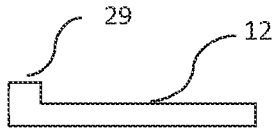
FIG. 2B is a cross-sectional view of the device.
Figure 3:
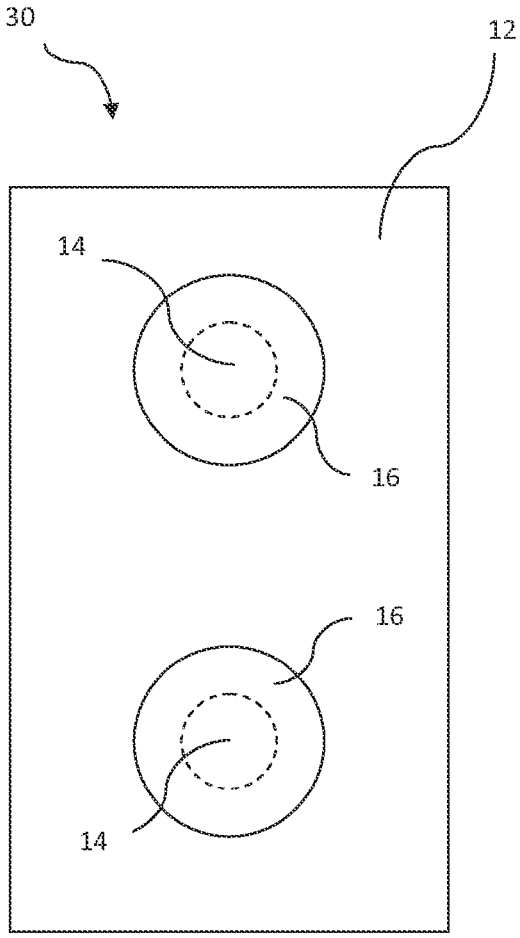
FIG. 3 is a front view of an embodiment of the magnetic holding mechanism.

The invention is a magnetic holding device that allows a user to safely and easily store individual knives in a drawer or hang individual knives on kitchen utensil racks without damaging or dulling the cutting surface of the knife. The device uses at least one magnet embedded within a blade guard, with the magnet being offset from the edge of the blade guard. The position of the magnet is important for two reasons: (1) it keeps the magnetic force away from the cutting edge of the blade to prevent undesirable magnetization of the cutting edge; and (2) it allows crisper and easier mechanical separation of the knife from the holder, with no "hanging on" caused by magnetic attachment at the cutting edge or the back edge of the blade to the magnet. The attachment face of the blade guard is covered with a plurality of compliant high coefficient of friction contact pads. The contact pads enhance the frictional holding force of the magnet and protect the knife from contact damage. The contact pads are disposed in parallel and planar relation to each in two or more distinct locations separated by a sufficient moment arm to prevent rotation of the knife when the blade guard is situated in differing orientations. The frictional contact pads can be a film attached to the attachment face of the blade guard or can be formed of the same material as the blade guard itself. The frictional contact pads can be connected to each other to form one pad; however, the points of contact between the knife blade and the enhanced frictional surface must be in distinct locations separated by sufficient distance to achieve a moment arm. This is best achieved by a raised surface at the desired points of contact.

The advantage to minimizing magnetic holding (normal) force while maximizing blade holding friction forces is that it prevents inadvertent sliding and rotation and allows the blade to be securely held in any orientation while at the same time being easily detached and attached. This improves safety and usability. Moreover, because the price of a magnet is a function of its holding force, this also reduces cost.

As depicted in FIGS. 1-8, the magnetic knife guard generally includes blade guard 10, magnetic holding mechanism 30, hanging void 24, finger release lever 28, raised edge 29, and attachment face 12. Magnetic holding mechanism 30 includes magnet 14 and frictional contact pads 16. Magnetic shield 18 can be attached to blade guard 10 opposite attachment face 12.

Figure 4:
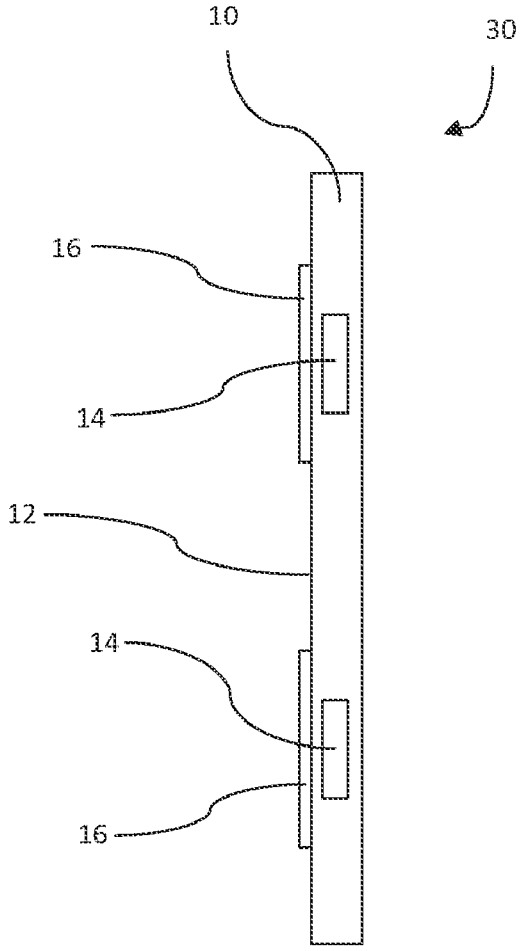
FIG. 4 is a cross-sectional view of an embodiment of the magnetic holding mechanism.
Figure 5:
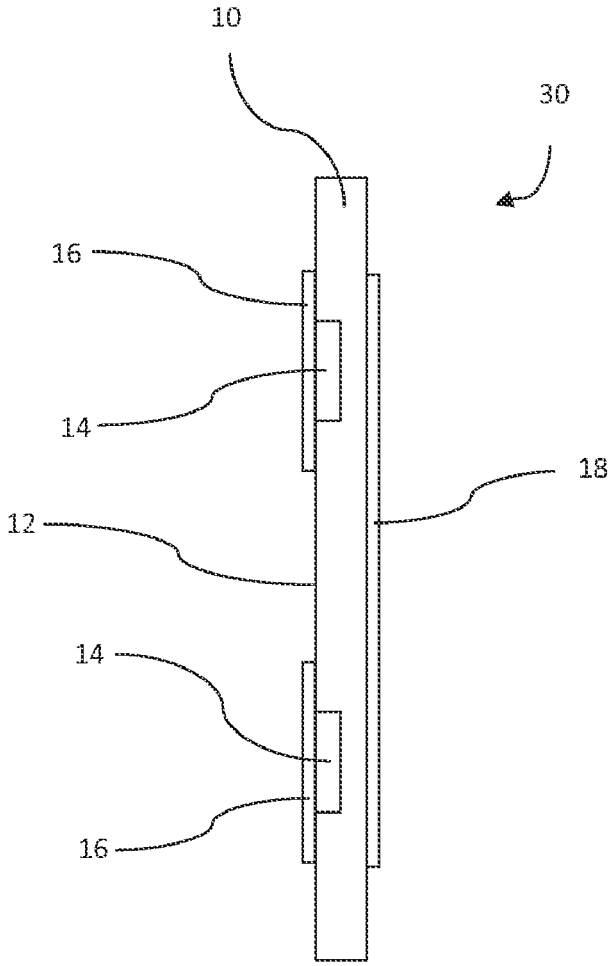
FIG. 5 is a cross-sectional view of an embodiment of the magnetic holding mechanism.
Figure 6:
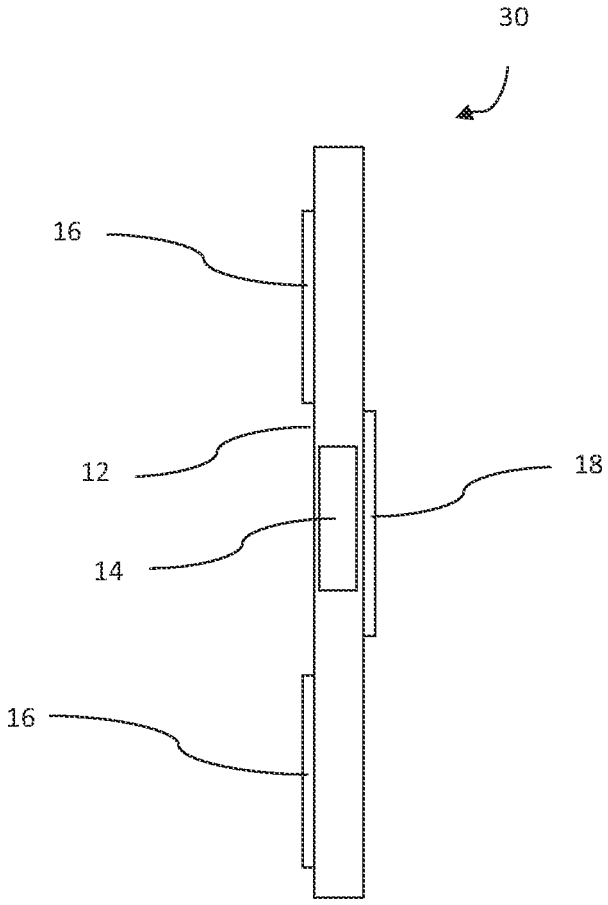
FIG. 6 is a cross-sectional view of an embodiment of the magnetic holding mechanism.

In magnetic holding mechanism 30, as depicted in FIGS. 3-7, at least one magnet 14 is embedded within blade guard 10. Frictional contact pads 16 are positioned in parallel and planar relation to one another at discrete locations on attachment face 12 to create a moment arm. Frictional contact pads 16 may be placed directly over magnet 14 on attachment face 12, as depicted in FIGS. 3-5 and 7, or, alternatively, frictional contact pads 16 may be positioned offset of magnet 14 on attachment face 12, as depicted in FIG. 6. When a knife is positioned against attachment face 12, magnet 14 pulls the knife against frictional contact pads 16 and attachment face 12.

Figure 7:
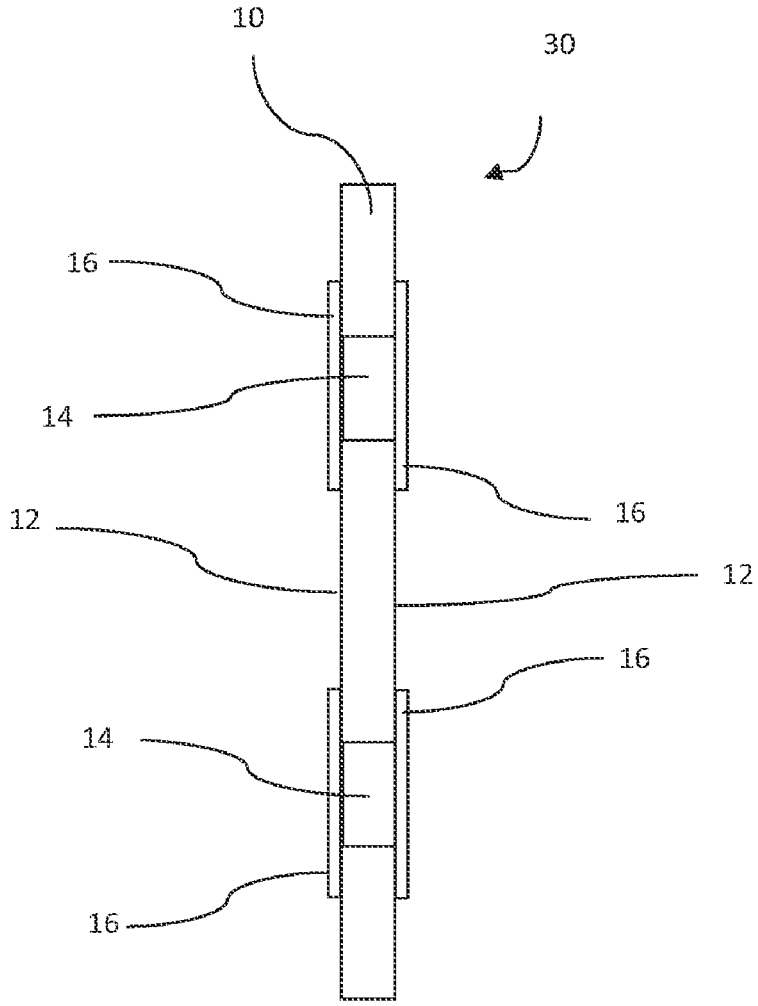
FIG. 7 is a cross-sectional view of an embodiment of the magnetic holding mechanism.

Magnet 14 may be wholly disposed within blade guard 10, with frictional contact pads 16 disposed on attachment face 12, as depicted in FIGS. 4 and 6, or magnet 14 may be partially disposed within blade guard 10, with frictional contact pads 16 holding magnet 14 within blade guard 10, as depicted in FIGS. 5 and 7.

Figure 8:
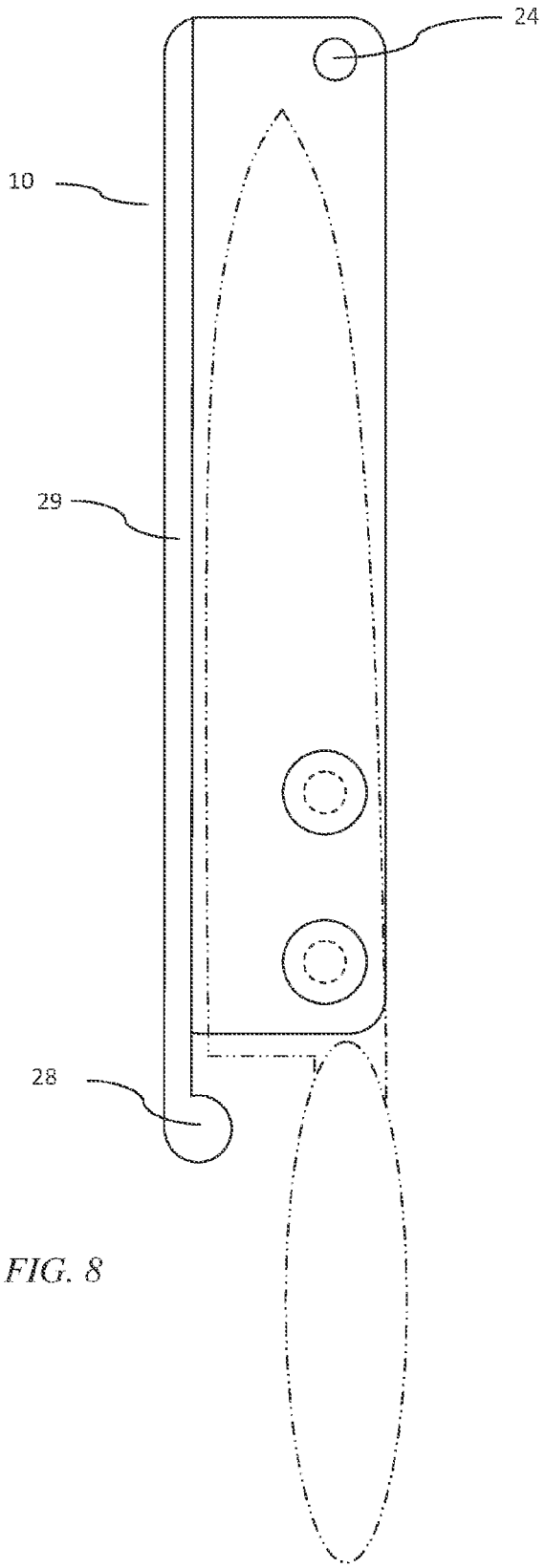
FIG. 8 is a front view of the device with a knife attached thereto.

As depicted in FIG. 8, blade guard 10 extends beyond the length of the knife and protects the cutting edge and point of the knife from the user. Raised edge 29 further protects the user from accidental contact with the cutting edge. Raised edge 29 can have different geometries, such as an internal or external radius, or it could wrap around and hang over the cutting edge. Hanging void 24 is disposed at the end opposite the knife handle of an attached knife and enables a user to hang blade guard 10 on kitchen racks or other mechanical protrusion. A plurality of holes, or an elongated hole, perpendicular to the length of the guard can be employed to ensure that the guard can be hung in alignment with the center of gravity of the knife so that the guard and knife hang vertically. A hook or loop attached to blade guard 10 can also be used as a hanging means. Finger release lever 28 is located at the end of blade guard 10 closest to the knife handle of an attached knife and within reach of an index finger or thumb of a user holding the knife, enabling one-handed detachment of the blade guard. This embodiment enables cutlery to be hung safely and conveniently from kitchen utensil racks.

In a preferred embodiment, frictional contact pads 16 have a coefficient of friction greater than 0.6, such as a polymer, e.g., polyurethane. Other polymers with enhanced friction properties are envisioned including thermoplastic elastomers (TPE), which can be economically applied by overmolding. Magnets 14 are rare earth magnets, and blade guard 10 is transparent.

As depicted in FIGS. 5 and 6, magnetic shield 18 is disposed on the side opposite attachment face 12 of blade guard 10, allowing multiple devices to be hung or stored in close proximity to one another without sticking. The magnetic shield may include a thin layer of a material with high magnetic permeability, e.g., steel or a nickel-iron alloy, to limit the effect of magnet 14. Magnetic shield 18 may be detachable from blade guard 10. Conversely, magnetic shield 18 may be permanently adhered to the surface opposite attachment face 12 or embedded in blade guard 10 adjacent to magnet 14.

Although in the preferred embodiment attachment face 12 and frictional contact pads 16 are depicted as being on only one side of blade guard 10, in an alternate embodiment, as depicted in FIG. 7, attachment face 12 and frictional contact pads 16 may be on both sides of blade guard 10 concurrently. Thus, a knife could be attached to either side of blade guard 10. The other advantage of this embodiment is that the opposite attachment face from the knife can be used to magnetically attach the guard and knife to a magnetic surface in the kitchen or a specially designed holding rack with steel or other magnetic attachment points. This mounting method will take advantage of the non-slip, non-rotating attachment face to securely store the knife and guard in any orientation.

A prototype was made from 0.125 inch laser cut clear acrylic with N42 neodymium rare earth magnets. The magnets are 0.25 inches in diameter and 0.125 inches thick. The magnets are located in two mounting holes, two inches apart, with clear adhesive polyurethane film 0.014 inches thick with a durometer harness of 80 A overlying the magnets and acting as the contact pads holding the magnets in their mounting holes. The thinner the polymer film covering the magnets, the less loss of magnetic force. If the magnet is not firmly held in the substrate or if the substrate is compliant, the magnet can deflect the polymer when it is attracted to the knife surface and slightly protrude, creating better contact between the polymer contact pads with the knife surface, maximizing friction forces.

In addition to being hung on kitchen racks, blade guard 10 can be incorporated into other holders specially designed to support its geometry.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A magnetic knife holding device, comprising:

a blade guard having at least one attachment face, said blade guard adapted to receive a knife having a handle end and a knife blade with pointed end;

at least one magnet embedded within said blade guard, wherein the entirety of said at least one magnet is disposed in a bottom portion of said blade guard and is aligned and parallel to the longitudinal axis of said blade guard, said bottom portion being remote from said pointed end and proximal to said handle end of said knife; and a plurality of compliant enhanced frictional contact pads disposed on said at least one attachment face and offset from said at least one magnet, wherein the entirety of said plurality of enhanced frictional contact pads are disposed in said bottom portion of said blade guard, said plurality of enhanced frictional contact pads each having an enhanced frictional surface with at least one point of contact between said enhanced frictional contact pads and a knife blade, said plurality of enhanced frictional surface each having a coefficient of friction higher than a coefficient of friction of said blade guard and greater than 0.6, said plurality of enhanced frictional surface each providing enhanced holding force of said at least one magnet, said plurality of enhanced frictional contact pads being disposed at discrete locations to create a moment arm sufficient to prevent rotation of the knife.

2. A magnetic knife holding device as in claim 1, wherein said at least one magnet is positioned a sufficient distance away from a periphery of said blade guard to prevent magnetization of a cutting surface of an attached knife.

3. A magnetic knife holding device as in claim 1, further comprising:

a finger release lever disposed at said bottom portion of said blade guard.

4. A magnetic knife holding device as in claim 1, further comprising:

at least one hanging void disposed in said blade guard.

5. A magnetic knife holding device as in claim 1, wherein said plurality of enhanced frictional contact pads formed of polymer.

6. A magnetic knife holding device as in claim 1, wherein said enhanced frictional contact pads and said blade guard are formed of the same material.

7. A magnetic knife holding device as in claim 1, wherein said blade guard is transparent.

8. A magnetic knife holding device as in claim 1, further comprising:

a magnetic shield disposed on said blade guard on a surface opposite said at least one attachment face.

9. A magnetic knife holding device as in claim 1, wherein said plurality of enhanced frictional contact pads are disposed in overlying relation to said at least one magnet on said at least one attachment face.

10. A magnetic knife holding device as in claim 1, further comprising:

a raised edge projecting from said at least one attachment face of said blade guard, said raised edge and at least one attachment face forming an "L" shape.

11. A magnetic knife holding device as in claim 1, further comprising:

a means for hanging said device.

12. A magnetic knife holding device as in claim 8, further comprising:

said magnetic shield being formed of a material having a high magnetic permeability.

* * * * *